US006302998B1

(12) United States Patent
Burgess

(10) Patent No.: US 6,302,998 B1
(45) **Date of Patent: *Oct. 16, 2001**

(54) METHOD AND APPARATUS FOR EMBOSSING WEB MATERIAL USING AN EMBOSSING SURFACE WITH OFF-CENTERED SHOULDERS

(75) Inventor: William H. Burgess, Palmyra, VA (US)

(73) Assignee: Kimberly-Clark Worlwide, Inc., Neenah, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/455,998

(22) Filed: Dec. 7, 1999

Related U.S. Application Data

(63) Continuation of application No. 09/000,535, filed on Dec. 30, 1997, now Pat. No. 6,080,276.

(51) Int. Cl.[7] ..... D21F 11/00
(52) U.S. Cl. ..... 162/109; 162/113; 162/117
(58) Field of Search ..... 162/109, 113, 162/117, 362

(56) References Cited

U.S. PATENT DOCUMENTS

| | | | | |
|---|---|---|---|---|
| 3,130,412 | | 4/1964 | Fox et al. . | |
| 4,211,743 | | 7/1980 | Nauta et al. . | |
| 4,529,480 | | 7/1985 | Trokhan . | |
| 4,543,142 | | 9/1985 | Kuepper et al. . | |
| 4,671,983 | | 6/1987 | Burt . | |
| 4,759,967 | | 7/1988 | Bauernfeind . | |
| 4,921,034 | * | 5/1990 | Burgess et al. | 162/109 |
| 5,356,364 | | 10/1994 | Veith et al. . | |
| 5,366,785 | | 11/1994 | Sawdai . | |
| 5,383,778 | | 1/1995 | Schulz . | |
| 5,436,057 | | 7/1995 | Schulz . | |
| 5,458,950 | | 10/1995 | Bredenick et al. . | |
| 5,490,902 | | 2/1996 | Schulz . | |
| 5,562,805 | | 10/1996 | Kamps et al. . | |
| 5,597,639 | | 1/1997 | Schulz . | |
| 6,080,276 | | 6/2000 | Burgess . | |

* cited by examiner

*Primary Examiner*—Peter Chin
(74) *Attorney, Agent, or Firm*—Gregory E. Croft

(57) ABSTRACT

Webs can be embossed using matched embossing elements with shoulders located off-centered. Such a configuration increases the bulk of the web and maintains the web's strength. The shoulder of one roll is located above or below the embossing surface mid-plane. The shoulder of the second roll substantially matches the off-centered elements of the first roll.

10 Claims, 3 Drawing Sheets

METHOD AND APPARATUS FOR EMBOSSING WEB MATERIAL USING AN EMBOSSING SURFACE WITH OFF-CENTERED SHOULDERS

This application is a continuation of application Ser. No. 09/000,535 entitled METHOD AND APPARATUS FOR EMBOSSING WEB MATERIAL USING AN EMBOSSING SURFACE WITH OFF-CENTERED SHOULDERS and filed in the U.S. Patent and Trademark Office on Dec. 30, 1997 now U.S. Pat. No. 6,080,500 per Tim Boyd. The entirety of application Ser. No. 09/000,535 is hereby incorporated by reference.

TECHNICAL FIELD

This invention generally relates to an apparatus and method of embossing a cellulosic web of material, and more particularly to embossing a cellulosic web of material using embossing elements with shoulders located away from the embossing surface mid-plane.

BACKGROUND

Paper products generally in the form of a cellulosic web, such as paper towels, wipers, and facial tissue are manufactured widely in the paper making industry. Each product has unique product characteristics requiring the appropriate blend of product attributes to ensure that a product can be used in its intended use locus. These attributes include tensile strength, water absorbency, softness, and bulk.

To achieve these product attributes, different manufacturing processes are utilized. One common process is embossing. Embossing increases the bulk of the product and enhances absorbency. In addition, embossing improves the product's aesthetic appeal. Generally, a stiffer web is easier to emboss because the more resilient the web is, the more difficult it is to retain the embossing pattern. However, increasing web stiffness has an adverse impact on web softness. Also, traditional embossing methods reduce the strength of the web. Therefore conventional embossing techniques tend to reduce the strength of the web in an effort to attain suitable bulk.

Conventional embossing techniques include a matched pair of embossing rolls, arranged to move relative to each other to form a roll nip. Generally the web is embossed by passing it through matching male and female embossing elements. The protrusion of the male element on one roll matches within the depression of the female element on the opposite roll, thereby deflecting the web and imparting an embossment at that point. The amount of penetration by the male element into the female element affects the extent of embossing. Traditional embossing techniques have been concerned with varying the amount of penetration. Embossing patterns have been altered in order to increase bulk yet maintain web strength. Much of these conventional embossing improvements have centered on the configuration of the embossing pattern. For example, the embossing pattern has been altered to produce a higher bulk and softer embossed sheet. See U.S. Pat. No. 5,562,805 to Kamps et al., where fine-scale intermeshed embossing elements of two rolls emboss the tissue thereby increasing tissue surface fuzziness which can improve softness.

Recent attempts have concentrated on the distinct geometry of the male and female embossing elements. For example, U.S. Pat. No. 5,356,364 to Veith et al. utilizes unmatched male and female embossing elements. The side wall slope of the matched elements are different, causing the web to be pinched at distinct points within each embossing element.

Other recent improvements in embossing methods involve adding a ridge or shoulder to the embossing elements. See U.S. Pat. No. 4,543,142 to Kuepper et al, where a shoulder is placed at the elements mid-plane. See also, U.S. Pat. No. 4,921,034 to Burgess et al, where a paper product has a plurality of bosses alternating about a centered shoulder.

Other attempts to improve the embossing pattern have involved changing the roll material from traditional steel to a softer material. See U.S. Pat. No. 4,211,743 to Nauta et al., where the embossing rolls have a resilient surface of varying hardness. The resilient surfaces temporarily deform within the nip thereby ensuring that the web material is fully contacted by the embossing pattern.

Traditional embossing methods of cellulosic webs continue to have many shortcomings. There is a need for an embossing method that increases the bulk of the web while maintaining adequate web strength.

SUMMARY

The present invention provides a method and apparatus for embossing a cellulosic web by passing the web between first and second rotatable rolls. The rotatable rolls have an embossing pattern with alternating male and female elements. Each roll has an embossing pattern mid-plane located equidistant the male element top and female element bottom. The first roll has shoulders located between the embossing pattern mid-plane and the male element top, and the second roll has its corresponding shoulders located between the embossing pattern mid-plane and the female element bottom. The corresponding male and female embossing elements intermesh and deflect the web perpendicular to its plane causing alternating protrusions and depressions in the web.

DETAILED DESCRIPTION

Figure 1:
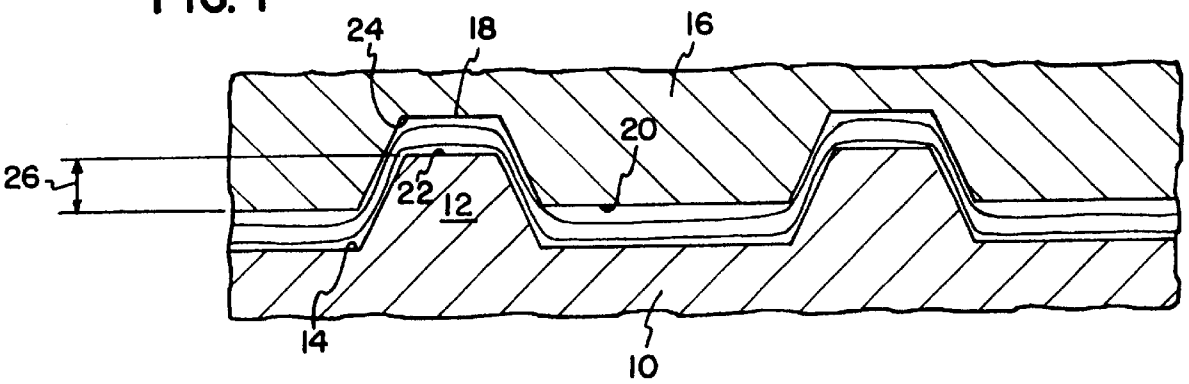
FIG. 1 is a fragmentary schematic front view of prior art embossing using an embossing roll with male elements.

The invention resides in an embossed cellulosic web product, including paper and tissue, that can be used to form a facial tissue or towel structure. The web can be layered or nonlayered, creped or uncreped, wet pressed or throughdried, preheated, premoistened, and can be single-ply or two-ply or multiply ply.

A preferred embodiment of the invention will be described in detail with reference to the drawings, wherein like reference numerals represent like parts and assemblies throughout the several views. Reference to the preferred embodiment does not limit the scope of the invention, which is limited only by the scope of the claims attached hereto.

In general, the present invention relates to an apparatus and method of embossing a cellulosic web of material, and more particularly to embossing a web of cellulosic material using embossing surfaces with shoulders located away from the embossing surface mid-plane. Depending on the embodiment that is used, the invention allows for an embossed web with increased bulk that maintains web strength.

The present invention has many advantages. One advantage is that it increases bulk in an embossed web, by utilizing a unique embossing structure. The increased bulk yields more roll building such that less web is required to produce a roll of constant diameter. The present invention allows for this increase in bulk yet maintains adequate levels of web strength.

FIG. 1 shows a prior art embossing process in which a web is embossed between matched embossing elements. Generally, male embossing elements are protrusions and female embossing elements are depressions. First embossing roll 10 has male embossing elements 12 extending from the first roll surface 14. Second embossing roll 16 has female embossing elements 18 recessed from the second roll surface 20. The male embossing elements 12 engage with the female embossing elements 18. The top 22 of the male element partially penetrates the female depression. The top 22 of the male element may or may not come into contact with the bottom 24 of the female element. The degree of roll engagement is indicated by the distance 26, which is the distance that the male element penetrates the female depression. The distance 26 is known as the embossing level. The embossing level is used to control the amount and quality of the embossments. For example, a higher embossing level leads to more penetration and therefore to larger embossments.

Figure 2:
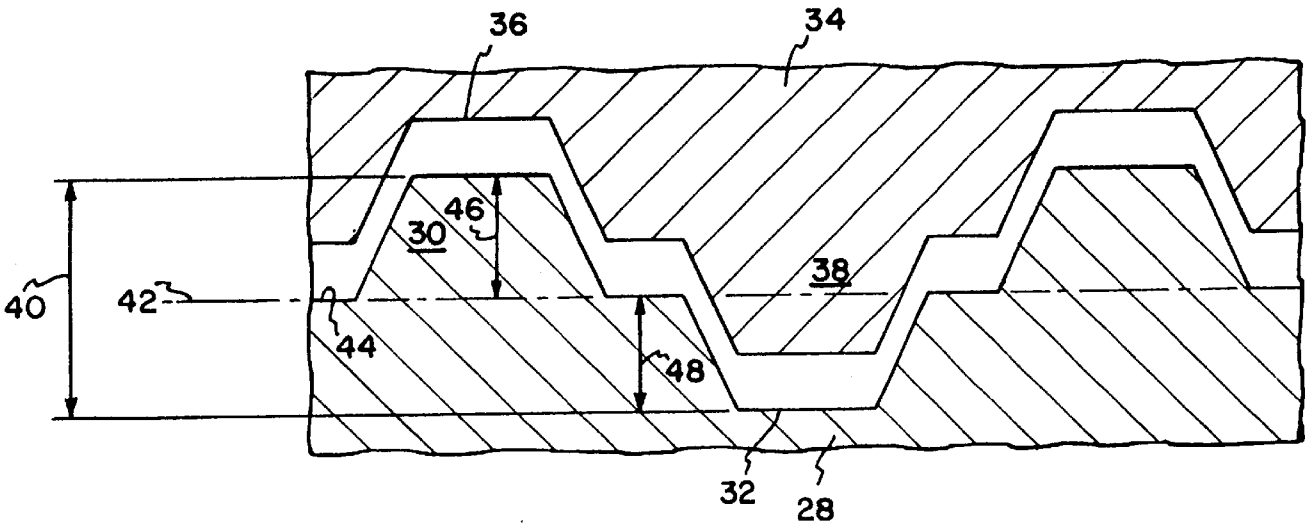
FIG. 2 is a fragmentary schematic front view of prior art embossing rolls with male and female embossing elements alternating about a centered shoulder.

FIG. 2 shows a prior art embossing method in which both rolls contain male and female embossing elements. The first roll 28 has male embossing elements 30 and female embossing elements 32. The second roll 34 has female embossing elements 36 and male embossing elements 38. The depth of the first roll's embossing surface is indicated by reference numeral 40. The mid-plane of the embossing roll surface is indicated by line 42. The embossing roll's shoulder 44 coincides with the embossing surface's mid-plane. This configuration is conventional. In such a configuration, the height 46 of the male embossing element is substantially equal to the depth 48 of the female element. Conventional embossing methods allowed for minor variations in the depth of the female element to account for dust or other particulate matter that may settle in the grooves of the female elements.

Figure 3:
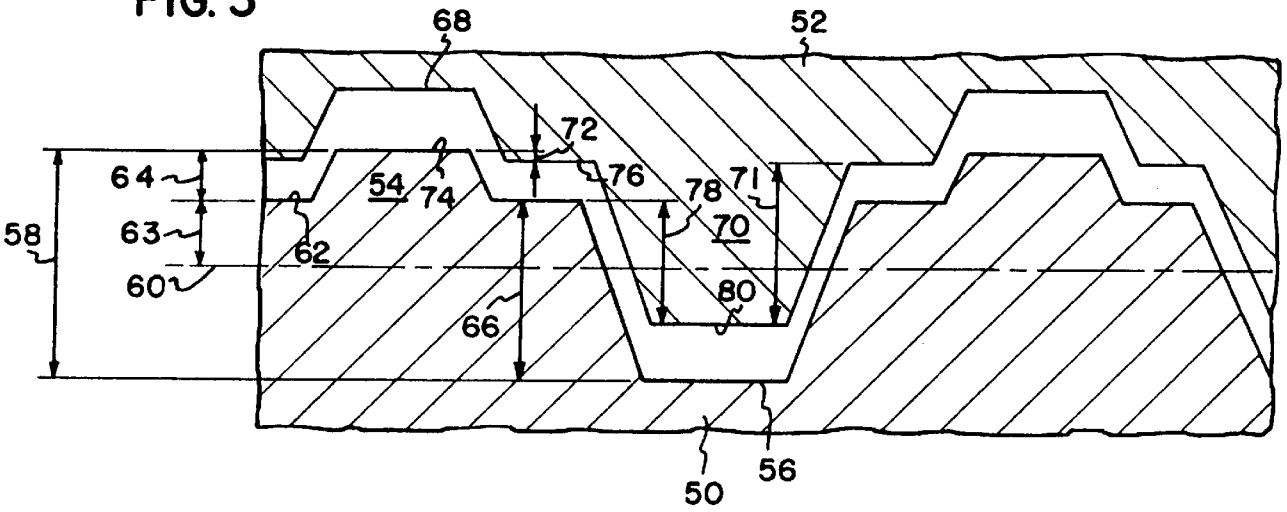
FIG. 3 is a fragmentary schematic front view of the embossing method of the present invention.

FIG. 3 shows the method of embossing according to the principles of the present invention. A first embossing roll 50 engages a second embossing roll 52 to emboss the cellulosic web. The first roll 50 has male embossing elements 54 and female embossing elements 56. The depth of the embossing surface is indicated by reference numeral 58 and the mid-plane of the embossing surface is indicated by the line 60. The shoulder 62 of the first embossing roll 50 does not coincide with the mid-plane 60. The shoulder 62 is located above the mid-plane 60 by the distance 63. The shoulder 62 is also known as the shelf or source plane. The height of the male element is indicated by reference numeral 64 and the depth of the female element is indicated by reference numeral 66. The female depth 66 is greater than the male height 64. The ratio of male height 64 to female depth 66 is between 0.0625 and 0.4375 preferably 0.25.

The second roll 52 has a corresponding set of female elements 68 and male elements 70. The first roll's male and female elements 54, 56 substantially match the second roll's female and male elements 68, 70. For example, the depth 66 of the first roll's female element 56 is substantially equal to the height 71 of the second roll's male element 70. The male embossing elements are designed to partially engage the corresponding female embossing element. The first roll's embossing level is indicated by reference numeral 72 which is the distance from the top 74 of the first roll's male element to the shoulder 76 of the second roll 52. The second roll's embossing level is indicated by reference numeral 78 which is the distance between the first roll's shoulder 62 and the top 80 of the second roll's male element 70. In the preferred embodiment, as shown in FIG. 3, the shoulder 62 of all male embossing elements is located the same distance 63 from the mid-plane 60. As a result, the embossing level and all resulting embossments will be of the relatively similar dimensions.

In designing the size of the male and female embossing elements, it is preferable that the length and width of the elements is equal to or greater than the distance between surrounding adjacent elements. If the element size is maintained a constant, the density of the elements (the number of elements per square centimeter) can be increased by decreasing the space between the elements. Alternatively, if the density of the element is maintained constant, the element size can be increased by decreasing the space between the elements.

The vertical profile of the male and female embossments can take on multiple configurations. In the preferred embodiment, the male and female embossments are oblong in shape, when viewed from the top. The preferred embossments are shown in U.S. Pat. No. 4,921,034, herein incorporated by reference. It will be appreciated that the precise spacing and shape of the embossments can vary depending upon the process requirements. Alternatively, the embossments may shape when viewed from the top including but not limited to hexagonal, oval, circular, and rectangular.

Figure 4:
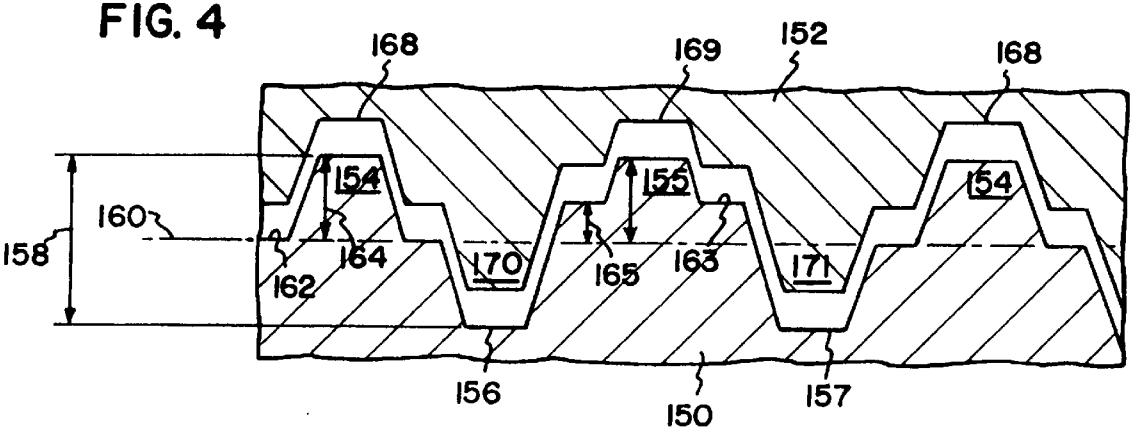
FIG. 4 is an alternative embodiment of the embossing method of the present invention showing an embossing surface with shoulders alternating between off-centered and centered.

FIG. 4 shows an alternative configuration of the embossing method of the present invention showing the shoulder alternating between an off-centered and centered position. A first embossing roll 150 engages a second embossing roll 152 to emboss the cellulosic web. The first roll 150 has two sets of male embossing elements 154, 155 and two sets of female embossing elements 156, 157. The depth of the embossing surface is indicated by reference numeral 158 and the mid-plane of the embossing surface is indicated by line 160. Roll 150 has two sets of shoulders 162, 163. The first shoulder 162 is associated with the first set of male embossing elements 154. The first shoulder 162 coincides with the mid-plane 160. The height of the first male embossing element is indicated by reference numeral 164. The second shoulder 163 is associated with the second set of male embossing elements 155. The second shoulder 163 is located above the mid-plane 160 by a distance 165. The second roll 152 has two sets of female embossing elements 168, 169 and two sets of male embossing elements 170, 171. The first roll embossing element sets substantially match the corresponding second roll embossing element sets.

Such a configuration would produce a cellulosic web with embossments on each side. The resulting web would have alternating embossments. The embossment in the web imparted by element 154 would be higher than the web embossment imparted by element 155. This means that each consecutive embossment would be different. The resulting web would have more bulk than a web produced by the rolls described in FIG. 2. In addition, such a configuration would enhance the surface texture of the resulting product. It is believed that such a product would have superior aesthetic attributes as well as a surface with a variety of embossments.

It will also be appreciated that the distance 165 from the shoulder to the mid-plane can be varied. The ratio of the shoulder distance 165 to the male element height 164 distance is 0.125 to 0.875, preferably 0.5.

It will also be appreciated that the location of elements with off-centered shoulders can be varied. Different regions of the embossing surface can have off-centered shoulders. For example, the elements located near the center of the embossing rolls have matching elements with centered shoulders and the elements located near the edges of the embossing rolls have matching elements with off-centered shoulders. It is believed that webs produced from such a process would have greater bulk near the edges of the resulting web. Different combinations of off-centered shoulders can be used. These combinations lead to different patterns and different web bulk. There are many different suitable combinations of elements that are within the scope of the present invention. In addition, it is believed that such a web maintains adequate levels of strength.

Figure 5:
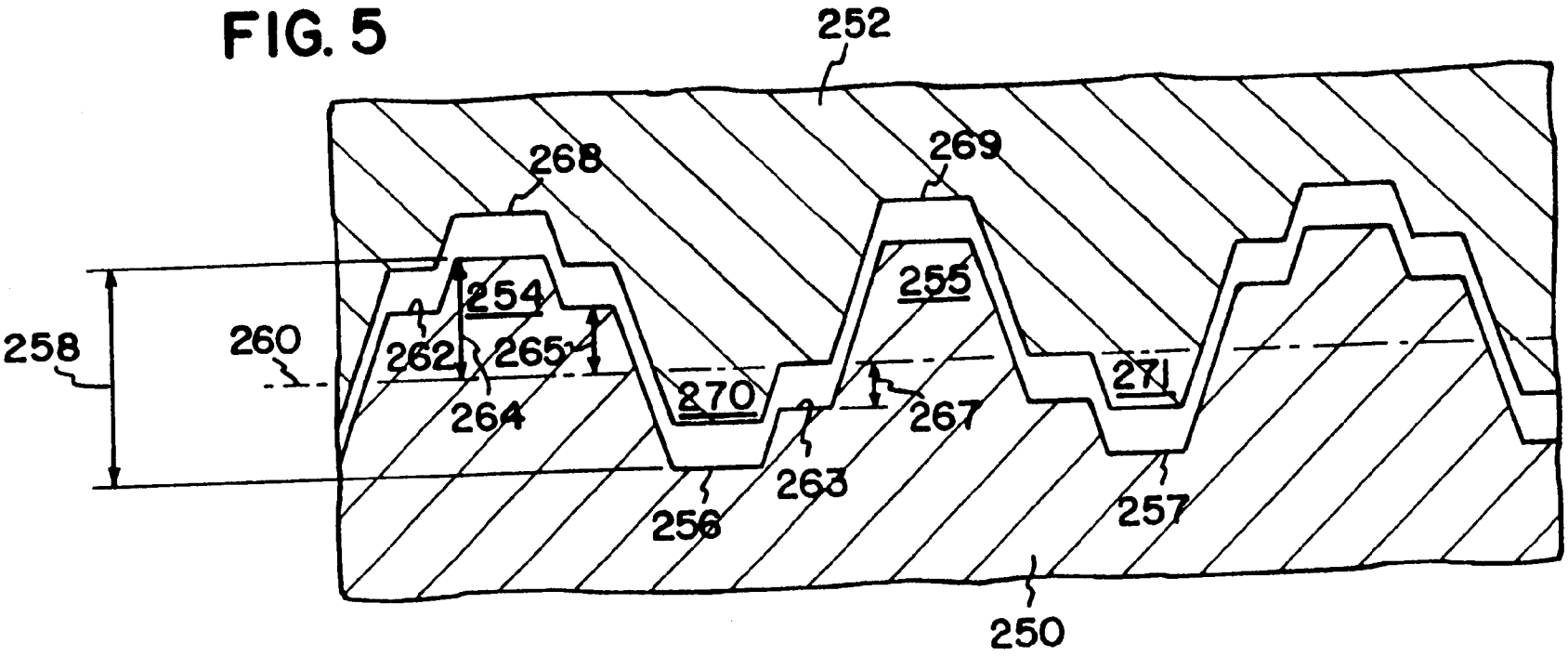
FIG. 5 is an alternative embodiment of the embossing method of the present invention showing an embossing surface with shoulders alternating above and below the surface mid-plane.

FIG. 5 shows yet another alternative configuration of the embossing method of the present invention. This method also utilizes off-centered shoulders. The shoulders are located both above and below the mid-plane. A first embossing roll 250 engages a second embossing roll 252 to emboss the cellulosic web. The first roll 250 has two sets of male embossing elements 254, 255 and two sets of female embossing elements 256, 257. The depth of the embossing surface is indicated by reference numeral 258 and the mid-plane of the embossing surface is indicated by line 260. Roll 250 has two sets of shoulder 262, 263. The first shoulder 262 is associated with the first set of male embossing elements 254. The first shoulder 262 is located a distance 26S above the mid-plane 260. The male element height is indicated by reference numeral 264. The second shoulder 263 is associated with the second set of male embossing elements 255. The second shoulder 263 is located below the mid-plane 260 by a distance 267. The second roll 252 has two sets of female embossing elements 268, 269 and two sets of male elements 270, 271. The first roll embossing element sets substantially match the corresponding second roll embossing element sets.

This configuration would produce a product with more bulk than a product produced by the rolls in FIG. 2. In addition, the products top and bottom surfaces would be substantially symmetrical. The top surface of the resulting web would have similarly sized and shaped embossments as the bottom surface.

In the preferred embodiment the embossing elements are matched steel. However, one or both of the rolls may be covered with a deformable surface, such as rubber or polyurethane. It is believed that deformable embossing elements yield slightly to the web and are less likely to damage the strength of the web during embossing. It is within the scope of this invention for the embossing elements to be steel or a combinations of steel and rubber or other deformable materials. For example, the male elements can be steel and the female elements can be a deformable material, or vice versa. There are many different suitable combinations of materials that are within the scope of the present invention. Deformable materials are more forgiving than steel and are less likely to cut the web as the top of the male embossing element penetrates the female element. The embossing rolls of the present invention can be manufactured using a laser engraving process.

In operation, as shown in FIG. 3, a web is passed between the first embossing roll 50 and second embossing roll 52. The corresponding male and female elements engage. The web, the first roll embossing surface or shoulder 62, and the second roll embossing surface or shoulder 76 move at substantially the same speed. As the male and female elements are engaged, the male element penetrates the female element thereby extending the web to create a permanent deformation or embossment. This embossment creates a corresponding bulk increase. The presence of the off-centered shoulder 62 creates a structure that allows for differentiation in the penetration of the male element. The embossments produced by this structure have more out of plane extension than a structure with the embossing surface located at the embossing surface mid-plane. As a result, the overall bulk of the product is increased.

Sheet specific bulk is expressed as cubic centimeters per gram. The invention resides in cellulosic webs having a sheet specific bulk of about 6 cubic centimeters per gram or greater, more preferably about 10 to 45 cubic centimeters per gram or greater.

Sheet bulk is derived from caliper. Caliper is measured substantially in accordance with TAPPI Standard T411-68 except for the loading on the pressure foot, which is 95 grams per square inch. The method utilizes a TMI Bench Micrometer, Model 549MSP having a 2 inch diameter anvil, and comprises placing a single sheet of tissue on the anvil such that all points on the peripheries of the contact surfaces are at least a 0.25 inch in from the edges of the sample. The instrument motor is started and two measurements are taken within 6 inches of each other in the cross-machine direction of the sample. A reading is taken near the end of the dwell time on each test and is read to the nearest scale division. The average of the two readings is the sheet caliper of the web. The invention resides in cellulosic webs having a sheet caliper of about 0.38 mm or greater, more preferably about 0.64 to 0.90 mm.

The embossing level is set according to the web material and the desired characteristics of the final web including strength and stack size density. The embossing level can be from about 0.1 to about 1.5 mm, more specifically from about 0.5 to about 1 mm.

The dimensions for the embossing elements provided herein are only for purposes of example and do not limit the scope of the claimed invention.

We believe that the use of the method of the present invention in embossing cellulosic sheets provides a substantial improvement in the bulk of the embossed sheet. The increase bulk is attained without comprising web strength.

Although the description of the preferred embodiment and method have been quite specific, modifications of the process of the invention could be made without deviating from the spirit of the present invention. Accordingly, the scope of the present invention is dictated by the appended claims, rather than by the description of the preferred embodiment and method.

I claim:

1. A method for embossing an absorbent paper web comprising the steps of:

(a) passing the web between first and second rotatable rolls, said rolls having a cylindrical outer surface, said surfaces having an embossing pattern, said first and second roll embossing patterns defined by a plurality of raised male elements and a plurality of recessed female elements, said male elements having a top and a base, said female elements having a bottom and a base, each roll having an embossing pattern mid-plane located equidistant male top and female bottom, each roll having an embossing shoulder located connecting adjacent male and female bases, at least one of said first roll embossing shoulders is located at said first roll embossing pattern mid-plane and at least one of said first roll embossing shoulders is located between said first roll embossing pattern mid-plane and said male top;

(b) rotating the rolls such that male and female embossing elements intermesh and deflect the web perpendicular to its plane causing protrusions and depressions in the web;

(c) driving the surface of the rolls at a speed substantially equal to the speed of the web; and (d) removing the web from the rolls.

2. The method of claim 1 wherein the first roll embossing shoulder that is located between the first roll embossing pattern mid-plane and the male top has a shoulder distance defined by the distance from the embossing pattern mid-plane to the embossing shoulder, and wherein the male element has a height defined by the distance from the embossing pattern mid-plane to the male element top, wherein the ratio of the shoulder distance to the male element height is from about 0.125 to about 0.875.

3. The method of claim 2 wherein the ratio is about 0.5.

4. The method of claim 1 wherein embossing elements are matched steel.

5. The method of claim 1 wherein embossing elements are a deformable material.

6. The method of claim 1 wherein one of the rolls's embossing elements are steel, and the other roll's embossing elements are a deformable material.

7. A method for embossing an absorbent paper web comprising the steps of:

(a) passing the web between the first and second rotatable rolls, said rolls having a cylindrical outer surface, said surfaces having an embossing pattern, said first and second roll embossing patterns defined by a plurality of raised male elements and a plurality of recessed female elements, said male elements having a top and a base, said female elements having a bottom and a base, each roll having an embossing pattern mid-plane located equidistant male top and female bottom, each roll having an embossing shoulder located connecting adjacent male and female bases, at least one of said first roll embossing shoulder is located between said first roll embossing pattern mid-plane and said female bottom, and at least one of said first roll embossing shoulders is located between said first roll embossing pattern mid-plane and said male top;

(b) rotating the rolls such that male and female embossing elements intermesh and deflect the web perpendicular to its plane causing protrusions and depressions in the web;

(c) driving the surface of the rolls at a speed substantially equal to the speed of the web;

and (d) removing the web from the rolls.

8. The method of claim 7 wherein the embossing elements are matched steel.

9. The method of claim 7 wherein the embossing elements are a deformable material.

10. The method of claim 7 wherein one of the roll's embossing elements are steel, and the other roll's embossing elements are a deformable material.

* * * * *